United States Patent [19]

Rubinsak et al.

[11] Patent Number: 4,988,317

[45] Date of Patent: Jan. 29, 1991

[54] SECTIONALIZED PONTOON FLOAT

[76] Inventors: Gilbert A. Rubinsak, 15516 Dismuke Dr., N. Biloxi, Miss. 39532; Richard Frese, 185 Iberville Dr., Biloxi, Miss. 39531

[21] Appl. No.: 272,110

[22] Filed: Nov. 16, 1988

[51] Int. Cl.[5] ..... B63B 35/00

[52] U.S. Cl. ..... 441/46; 114/267; 114/265

[58] Field of Search ..... 114/265–267, 114/263, 355, 68, 77 R, 77 A; 441/43–46; 14/27; 405/195, 218, 219; 52/578, 579, 588, 595

[56] References Cited

U.S. PATENT DOCUMENTS

| | | | |
|---|---|---|---|
| 2,669,960 | 2/1954 | Laycock | 14/27 |
| 2,962,996 | 12/1960 | Smith | 441/46 |
| 3,004,268 | 10/1961 | Haas | 441/46 |
| 3,109,183 | 11/1963 | Overmyer | 441/46 |
| 3,207,110 | 9/1965 | Laborde | 114/265 |
| 3,673,975 | 7/1972 | Strauss | 114/267 |
| 3,760,754 | 9/1973 | Drummond | 114/266 |
| 3,765,353 | 10/1973 | Rosenberg | 114/266 |
| 3,834,336 | 9/1974 | Peters | 114/267 |
| 4,286,538 | 9/1981 | Matsui | 114/267 |
| 4,561,376 | 12/1985 | Fitzgerald-Smith | 114/267 |
| 4,799,445 | 1/1989 | Meriwether | 114/267 |

FOREIGN PATENT DOCUMENTS

| | | | |
|---|---|---|---|
| 474794 | 6/1974 | Australia | 114/267 |

*Primary Examiner*—Joseph F. Peters, Jr.
*Assistant Examiner*—Clifford T. Bartz
*Attorney, Agent, or Firm*—Alexander F. Norcross

[57] ABSTRACT

A pontoon float has a flexible collapsible structure which may be extended by interlinking pontoon float platforms to form an elongated platform as for a dock or pier. Each pontoon float platform is supported by a rectilinear array of removable, stackable hollow floats, removably fastened to permanently affixed lid sections, forming an air tight seal. The individual floats are secured to the platform only by removable upper ends, and are otherwise free. The floats may be readily removed and stacked, reducing each pontoon platform to a planar section and a stacked, compact array of float members. The pontoon sections are reinforced by a grid of stringers, providing adequate rigidity without undue stiffness. Preferably, each pontoon sections is provided with interlocking extension plates on an end and a side and a mating pattern of interlocking holes on a second end and side so that they can be adjoined to form complex large floating structures as required.

9 Claims, 2 Drawing Sheets

SECTIONALIZED PONTOON FLOAT

BACKGROUND OF THE INVENTION

The patent pertains to Pontoon Flotation devices.

U.S. Pat. No. 2,669,960 discloses a segmented structure having a defined grid defining a lattice work of pontoon spaces (interstices) within which are placed inflatable vertical descending barrel shaped pontoons.

The framework is described as having a uniform air distribution system for inflation and deflation of the pontoons, and it is specifically designed to be folded into a more compact structure for stowage between deployments.

Other patents largely show various forms of mounting for horizontally mounted buoyancy drums. Thus, U.S. Pat. No. 3,109,183 to Overmyer discloses a structure in which a platform is erected upon longitudinal girders which are then strapped to end to end abutted horizontal drums through a claimed structural member for clamping onto the flanges of two adjoining drums; this flange both supports and secures the drums in an inline configuration.

An earlier structure shown in U.S. Pat. No. 3,004,268 to Haas shows end to end horizontal drums which are secured by means of a strapping arrangement which encloses the abutting flanges. See FIG. 4 of Haas.

U.S. Pat. No. 2,962,996 shows a specific clamping arrangement to flanges of individual drums for horizontally extending platform supports, providing a floating platform on individual, parallel drums.

U.S. Pat. No. 1,078,334 to Cook shows a life raft arrangement in which drums are enclosed within a clamped frame. A variation shown in British Patent No. 117,588 clamps the drums within the frame but uses this to define the outer structure or gunwales of a life raft to form a well deck for the protection of the inhabitants. Earlier versions of the clamped frame concept for the formation of life rafts are shown in U.S. Pat. No. 146,316 disclosing both an enclosing framework and a particular method of strapping the ends of the flotation drum to through support and French Patent No. 553408 disclosing flotation drums clamped within an upper and lower framework.

U.S. Pat. No. 42,594 shows an early form of clamp for securing multiple barrels together to form a raft, in which the clamp is designed to hold the barrels in a rigid spaced relationship for the reduction of chafing.

SUMMARY OF THE INVENTION

The instant invention is a form of linkable float or pontoon. The basic concept for the pontoon is that a basic 4'×8' support platform is divided by stringers into eighteen square sections. In each section a clampable lid is fixedly affixed to the platform.

Each such lid in turn is designed to hold a bucket base, which is otherwise hollow, in a sealed manner. Two edges of the 4'×8' platform are provided with dual metal securing strips, firmly affixed to the platform and extending out for a distance of some two inches; these strips, in turn, are designed to engage and be clamped to an adjoining sheet so as to build larger structures out of the basic element. The bucket devices are preferably of the same basic construction as a sealed plastic five gallon bucket, but the overall construction is that the bucket must be impervious, hollow and be of a type that clampingly engages to a lid forming an airtight seal.

Thus, an object of the invention to disclose a form of pontoon float having readily removable float members, which can be stacked and stored in a compact manner.

It is a further object of this invention to disclose a readily assembleable pontoon float which may be interlinked to form arbitrarily large floating deck structures.

It is a further object of this invention to disclose a flexible, lightweight, pontoon float, having a minimum of structural interconnections for ease of manufacture and assembly.

These and other objects of the invention may be more readily seen from the detailed description of the preferred embodiment which follows.

DETAILED DESCRIPTION OF THE PREFERRED EMBODIMENT

Figure 1:
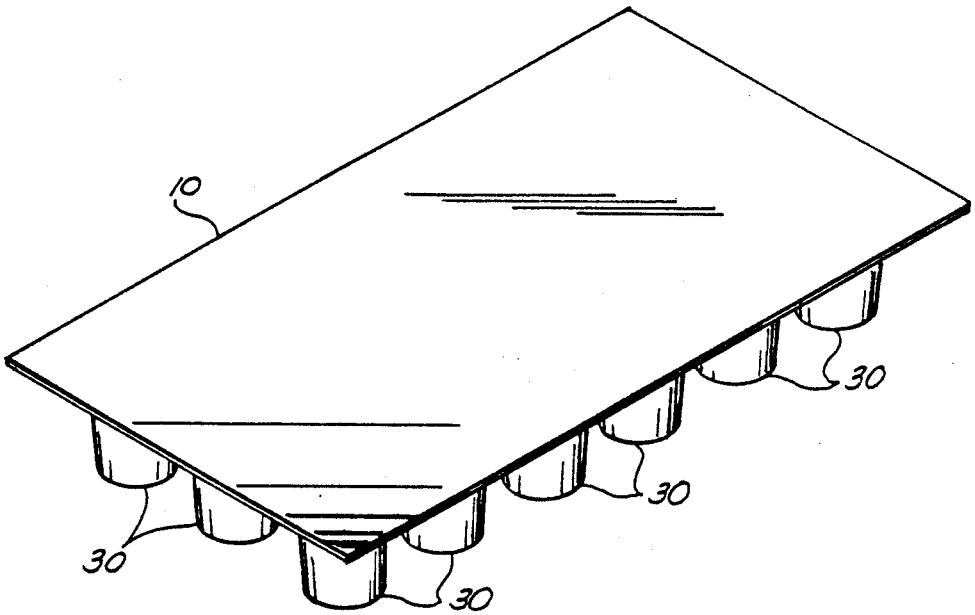
FIG. 1 is an angled view from above of a pontoon platform section with floats.
Figure 2:
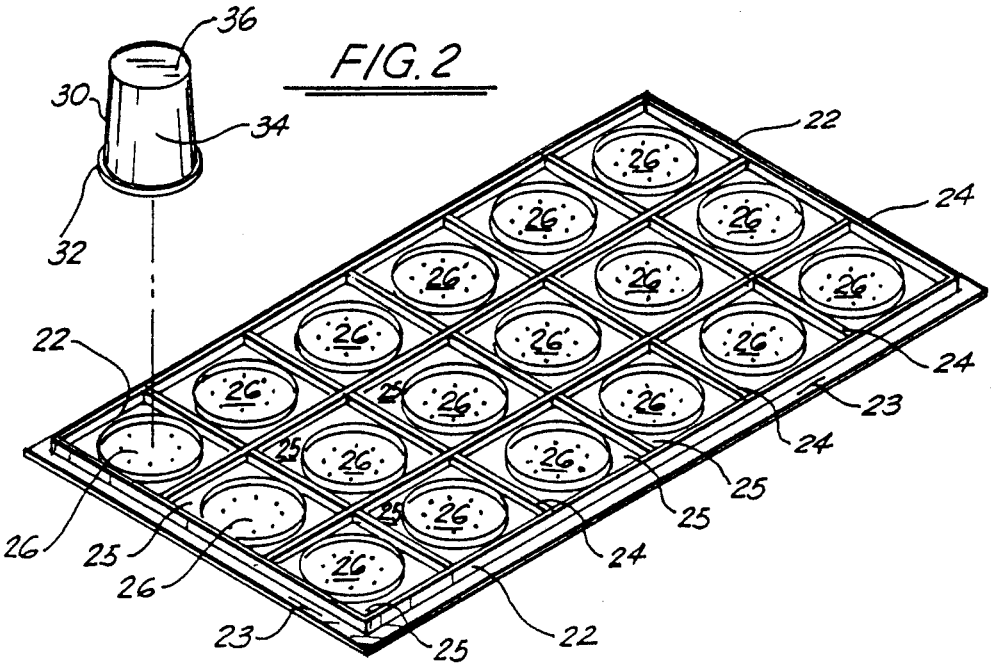
FIG. 2 is an inverted view of the platform showing the placement of an individual float.
Figure 3:
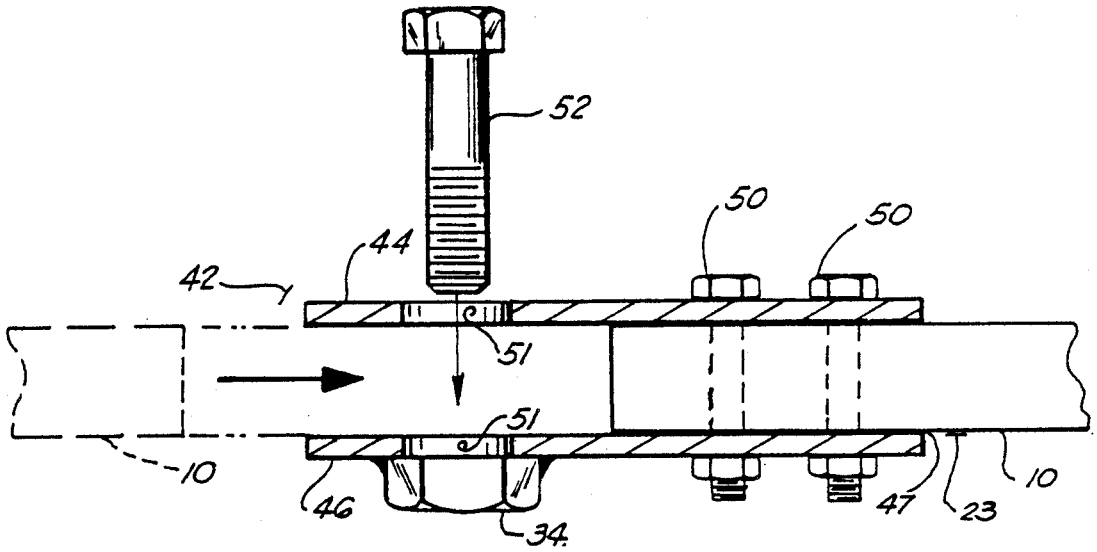
FIG. 3 is a side view of the platform extension plates showing the interlocking of two adjoining platform sections.
Figure 4:
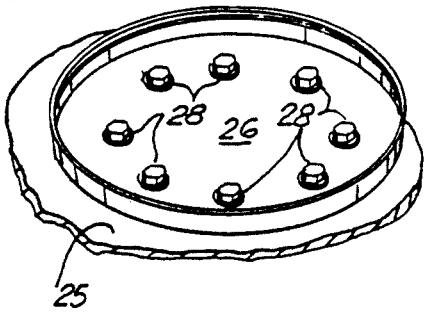
FIG. 4 is a detailed fastening of an individual float lid.
Figure 5:
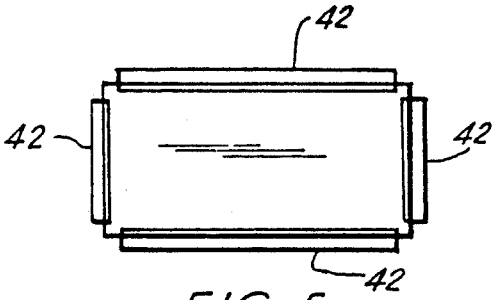
FIG. 5, FIG. 6 and FIG. 7 are three embodiments of standard pontoon platform showing the configuration beside the extension plates.
Figure 7:
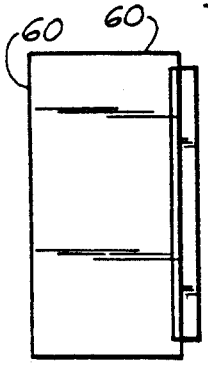
Figure 6:
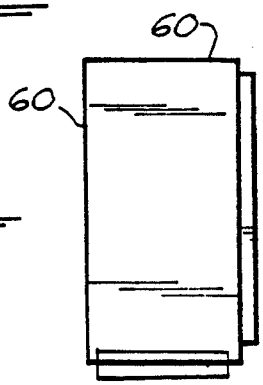

Referring to FIG. 1, an individual pontoon float platform 10 is shown. Each such pontoon float platform 10 is constructed upon a rectangular sheet 20. In the preferred embodiment sheet 20 is a standard 4'×8' sheet of marine grade plywood, although any suitable water resistant material will suffice. Preferably the aspect of the sheet is a rectangle having a length twice the width, of a size conveniently handled in individual form. On the underside of the sheet a grid is formed by the fastening of interlocking, perpendicular lengthwise stringers 22 and crosswise stringers 24. In a typical 4'×8' sheet these stringers will form eighteen individual grid squares 25. The stringers may be as simple as edge mounted 2'×4's nailed or otherwise fastened to plywood sheet 20 or any suitable rectangular material affixed to sheet 20. The spacing of the lengthwise stringers 22 and crosswise stringers 24 is such that a free edge space 23 is defined around the outer perimeter of sheet 20.

Within each grid square 25 a float lid support 26 is affixed. In preferred form each float is in cylindrical form and therefore, each float lid support 26 is circular form fastened by an array of lid hold bolts 28. It has been found that between six and eight such lid hold bolts are preferable for providing a uniform, even hold down; each such bolt should be provided with a sealant in the through hole provided through the hold lid to ensure air integrity. Either a gasket or any of the standard injectable sealants has been found satisfactory for this purpose. The lid hold bolts 28 hold each lid support 26 firmly to sheet 20.

Lid support 26 defines the upper edge of an individual float bucket 30. Float bucket 30 is interconnected to the lid support 26 through interlocking rim member 32, circumferentially extending around the outer edge of lid support 26 and a mating lid rim 32 circumferentially extending around an upper end of float bucket 30. Float bucket 30 is formed with substantially cylindrical sides 34, which in the preferred embodiment are tapered to promote stacking of the individual float buckets 30 when removed from the lid supports 26. Each float bucket 30 terminates in an enclosed bottom 36.

The interlocking rims 32 are a common form generally encountered in commonly encountered plastic bucket for carrying liquid material such as paint and in fact, with the 4'×8' sheet of plywood, an individual five gallon plastic paint bucket has been found ideal for the purpose of creating a float bucket 30. However constructed, interlocking rim 32 should be of a type forming an airtight seal uniformly around the edge of lid support 26 and float bucket 30. It is found that when such a seal is formed, insertion of pontoon float platform 20 in the water will not remove or tear free any of the individual float buckets 30 even though the bottoms 36 are totally without support and are free to move.

The cross stringers 22, 24 provide for an adequate degree of stiffness without an over degree of rigidity; some deformation of sheet 20 is encountered.

Nonetheless, it has been found experimentally that an individual pontoon float platform 10 constructed as described is capable of being moved through the water under power, and such floats have been successfully moved in a lake using a trolling motor without leaking or separation of the individual float buckets.

It can readily be seen that by tapering the individual float buckets 30, the individual buckets can then be stacked. This provides for a particularly efficient storage and shipping method for the pontoon floats 10 in that the individual float buckets 30 can be separated from their respective lids and stacked forming a single cylindrical stack. The remaining portion of pontoon float 10 then is simply a reinforced planar sheet; the stringers 22, 24 not only stiffen the sheet, but serve additionally as protectors to protect the interlocking rims 32 on lid supports 26 against damage. The resulting sheets can then be easily stacked and manipulated in the same manner as sheets of plywood may be manipulated.

The buckets may then be reinstalled by snapping them into place and the float is then ready for use.

It is further found that the individual float platforms 10 may be interlinked by providing a regular series of side extension plates 42 along preferably a side and an end of each pontoon float 10. In such form, side extension plates 42 are formed as mating, opposing top plate 44 and bottom plate 46. These plates are permanently affixed along their appropriate side of pontoon float 10 by plate fastening bolts 50, installed in pairs so as to resist clamping forces on top plate 44 and bottom plate 46 when the platforms are stored or moved. These plate fastening bolts 50 are of a relatively smaller size and in relatively larger numbers, providing for a uniform distribution of loading along the edges of the pontoon float platform 10.

Bottom plate 44 may be distinguished from top plate 46 in that, while both side extension plates 42 are provided with an array of interlocking bolt holes 51, bottom plate 46 has, affixed to an outer surface thereof, coaxial with bolt hole 51, a fixed bottom plate nut 54 for receiving a larger interlocking bolt 52. Interlocking bolt 52 serves to fasten an adjacent, nonextended plain edge 60 of a pontoon float platform 10. Plain edge 60 is provided with a platform interlock hole pattern or array 56 which is matched by a pattern or array for interlocking holes 51 with inside extension plates 42. Bottom plate 44 is preferably spaced from platform 10 by a spacing gasket 47; this eases the insertion of adjacent platforms 10.

Each interlocking bolt 52 is preferably a larger bolt; since the interlocking bolts 52 are not installed and serve no purpose when individual pontoon float platforms 10 are not joined together, there is no requirement that the pattern of interlocking bolts 52 maintain any spacing distance or integrity of unmounted side extension plates. Therefore, since interlocking bolt 52 serves only to withstand the forces attempting to separate two adjacent, joined pontoon float platforms 10, a smaller number of larger bolts may be used for interlocking bolts 52; this is in distinction to the bolt pattern for the plate fastening bolts 50 which should be larger in number but smaller in size to provide a more uniform distribution of loads both in adjoining the respective pontoon float platforms 10, as well as in supporting the side extension plates 42 when the platforms are separated.

It can be readily seen that the form of the platform 10 with side extension plates 42 admit to a rapid buildup, in a form that would be obvious to the user, of large floating structures suitable for temporary docks, pier or the like. By the same token, the easy collapsibility of the disclosed pontoon float platform 10 allows these structures to be readily separated and removed form use. By providing that the interlocking bolts are mated into a fixed bottom plate nut 54 permanently affixed to bottom plate 46, the individual platforms can be readily assembled and fastened by a worker working from the top of the platform, sliding two floating platforms together and thus, it is easy to assemble the platform on the water surface, minimizing the problem of moving and installing an assembled array of such platforms after construction.

It can thus be seen that the disclosed invention, discloses a particularly flexible pontoon float, easily collapsible to a stored configuration, yet readily extendable into a complex array using a minimum of components, and with those components being readily attainable.

It should thus be apparent that the invention extends not to the particular embodiment here shown but rather to that wider range of equivalents as are implicit in the claims.

I claim:

1. A pontoon float further comprising:
   a. a planar sheet means;
   b. means for stiffening said planar sheet;
   c. a plurality of float means in a symmetrical array mounted to said planar sheet;
   d. said float means further comprising: substantially vertical float being restrained only at a top surface thereof;
   e. means, extending along at least an edge of said planar sheet forming a detachable, rigidly interconnecting joint with a corresponding edge of a second said planar sheet means;
   f. said means along said edge further comprises:
      1. first, upper rectangular plate means and second, lower rectangular plate means;
      2. said first and said second plate means being affixed rigidly, parallel to each other along an edge of said planar sheet, defining thereby an elongate rectilinear groove;
      3. said groove being adapted to receive an edge of a second planar sheet;
      4. removable means for fastening rigidly said second planar sheet within said groove.

2. The apparatus of claim 1 above, wherein said rectangular planar sheet defining two parallel side edges and two parallel end edges, comprising:

a. a first such side edge and a first such end edge having said fastening means thereupon;

b. said removable fastening means defining a fastener pattern upon said edge plates;

c. said second side edge and said second end edge having a pattern of fastener receiving means corresponding to said pattern of removable fastener means.

3. The apparatus of claim 1 above, wherein said removable fastener means further comprise:

a. means passing through said upper edge plate, said lower edge plate, and said second planar sheet;

b. said means defining a pattern of rigid affixation;

c. means within said lower plate for receivingly holding said fastener means, said fastener means being installable and removable;

d. said fastener means being installable and removable by access solely from said upper edge plate.

4. A sectionalized pontoon float, each section comprising:

a. a substantially rectangular planar sheet;

b. a first plurality of parallel stiffening means affixed to a surface of said sheet;

c. a second plurality of parallel stiffening means, affixed to said surface of said sheet substantially perpendicular to said first plurality, defining thereby an array of rectilinear cells;

d. an array of vertically oriented floats, affixed, one float to each said cell, each of said floats further comprising:

e. a substantially cylindrical shape having a first closed end and having a second open end;

f. said open end having a circumferential, sealing rim means;

g. a disk lid means having a circumferential sealing rim corresponding to said sealing rim on said open end, forming thereby a closed, airtight cylindrical float;

h. said lid means being fastened to said sheet means within said cell.

5. The apparatus of claim 4 above, wherein:

a. said float cylindrical shape is tapered, said open end being larger than said closed end;

b. said cylindrical shapes being stackable.

6. The apparatus of claim 4 above, further comprising:

a. means, extending along at least an edge of said planar sheet forming a detachable, rigidly interconnecting joint with a corresponding edge of a second said planar sheet means.

7. The apparatus of claim 6 above, wherein said means along said edge further comprises:

a. first, upper rectangular plate means and second, lower rectangular plate means;

b. said first and said second plate means being affixed rigidly, parallel to each other along an edge of said planar sheet, defining thereby an elongate rectilinear groove;

c. said groove being adapted to receive an edge of a second planar sheet;

d. removable means for fastening rigidly said second planar sheet within said groove.

8. The apparatus of claim 7 above, wherein said rectangular planar sheet defining two parallel side edges and two parallel end edges, comprising:

a. a first such side edge and a first such end edge having said fastening means thereupon;

b. said removable fastening means defining a fastener pattern upon said edge plates;

c. said second side edge and said second end edge having a pattern of fastener receiving means corresponding to said pattern of removable fastener means.

9. The apparatus of claim 8 above, wherein said removable fastener means further comprise:

a. means passing through said upper edge plate, said lower edge plate, and said second planar sheet;

b. said means defining a pattern of rigid affixation;

c. means within said lower plate for receivingly holding said fastener means, said fastener means being installable and removable;

d. said fastener means being installable and removable by access solely from said upper edge plate.

* * * * *